US009539583B2

(12) United States Patent
De Hoog et al.

(10) Patent No.: US 9,539,583 B2
(45) Date of Patent: Jan. 10, 2017

(54) POWDER PURGING APPARATUS AND METHOD

(71) Applicant: DG press HoldinG B.V., Hall (NL)

(72) Inventors: Robin Marius De Hoog, Lunteren (NL); Pieter Kloppers, Apeldoorn (NL)

(73) Assignee: DG Press Holding B.V., Hall (NL)

( * ) Notice: Subject to any disclaimer, the term of this patent is extended or adjusted under 35 U.S.C. 154(b) by 3 days.

(21) Appl. No.: 14/379,964

(22) PCT Filed: Feb. 20, 2013

(86) PCT No.: PCT/NL2013/050108
§ 371 (c)(1),
(2) Date: Aug. 20, 2014

(87) PCT Pub. No.: WO2013/125952
PCT Pub. Date: Aug. 29, 2013

(65) Prior Publication Data

US 2016/0016179 A1 Jan. 21, 2016

(30) Foreign Application Priority Data

Feb. 20, 2012 (NL) ..... 2008319

(51) Int. Cl.
*B03C 1/12* (2006.01)
*G03G 15/09* (2006.01)
(Continued)

(52) U.S. Cl.
CPC ..... *B03C 1/12* (2013.01); *G03G 15/0844* (2013.01); *G03G 15/0887* (2013.01);
(Continued)

(58) Field of Classification Search
CPC ..... B03C 1/12; B03C 1/30; B03C 3/017; B03C 3/0175; B03C 9/00; G03G 15/0844; G03G 15/09; G03G 15/0921
See application file for complete search history.

(56) References Cited

U.S. PATENT DOCUMENTS 3,322,275 A * 5/1967 Breakiron ..... B03C 7/00 209/127.1
4,482,244 A * 11/1984 Yamazaki ..... G03G 21/0047 15/1.51
(Continued)

FOREIGN PATENT DOCUMENTS

DE 10 2004 046 744 A1 4/2006
JP S57105643 6/1982
(Continued)

OTHER PUBLICATIONS

International Search Report for International Application No. PCT/NL2013/050108 dated Jun. 24, 2013.
(Continued)

*Primary Examiner* — Joseph C Rodriguez
(74) *Attorney, Agent, or Firm* — Alston & Bird LLP

(57) ABSTRACT

Systems, methods, and apparatus are provided for purging charged powder particles from a mixture of ferromagnetic carrier particles and said powder particles. One example embodiment may include a powder purging apparatus comprising a support surface comprising a first side for supporting said carrier particles; a plurality of magnets, arranged on a second side of said support surface for generating magnetic fields at said first side to attract said carrier particles for forming a magnetic brush of said carrier particles, said magnetic fields and said support surface moveable relative to each other; an attracting surface facing said first side and spaced apart therefrom; and a field generator adapted for generating an electrical field between said attracting surface and said support surface for attracting said powder particles away from the carrier particles and towards said attracting
(Continued)

surface, wherein said magnetic brush of carrier particles is spaced apart from said attracting surface.

30 Claims, 11 Drawing Sheets

(51) Int. Cl.
*G03G 21/00* (2006.01)
*G03G 15/08* (2006.01)
*B03C 3/017* (2006.01)

(52) U.S. Cl.
CPC ..... *G03G 15/09* (2013.01); *G03G 21/00* (2013.01); *B03C 3/0175* (2013.01)

(56) References Cited

U.S. PATENT DOCUMENTS 4,882,043 A * 11/1989 Jung ..... B03C 1/12 209/12.2
4,885,612 A * 12/1989 Satoh ..... G03G 21/0047 15/256.52
5,404,215 A 4/1995 Bares
5,604,573 A * 2/1997 Endo ..... G03G 15/09 399/222
5,715,504 A * 2/1998 Sahay ..... G03G 15/0126 118/623
5,926,677 A * 7/1999 Ochiai ..... G03G 9/083 399/277
6,084,326 A * 7/2000 Nagai ..... F16H 25/2418 310/103
6,398,345 B1 * 6/2002 Sakai ..... B41J 11/007 347/55
6,449,448 B2 * 9/2002 Bessho ..... G03G 21/0064 399/100
6,751,430 B2 6/2004 Godlove
7,583,918 B2 * 9/2009 Samweber ..... G03G 21/0047 399/273
8,406,651 B2 * 3/2013 Selinger ..... G03G 15/0844 399/283
2001/0016127 A1 * 8/2001 Watanabe ..... G03G 15/0216 399/149
2004/0105706 A1 * 6/2004 Selinger ..... G03G 15/0921 399/273
2005/0006578 A1 * 1/2005 Rockwood ..... G01N 27/622 250/289
2005/0019071 A1 * 1/2005 Akagi ..... G03G 21/0035 399/356
2005/0036806 A1 * 2/2005 Hollig ..... G03G 21/0047 399/273

FOREIGN PATENT DOCUMENTS

JP 58 184176 A 10/1983
JP 60 119592 A 6/1985
JP S6388760 11/1986
JP 6358175 3/1988
JP S6390446 6/1988
JP H02242276 9/1990
JP H0422880 1/1992
JP 2002 268383 A 9/2002
JP 2006-317791 11/2006
JP 2006-323013 11/2006

OTHER PUBLICATIONS

Written Opinion for International Application No. PCT/NL2013/050108 dated Jun. 24, 2013.
Office Action for corresponding Japanese Application No. 2014-558706 dated Sep. 30, 2016.

* cited by examiner

POWDER PURGING APPARATUS AND METHOD

BACKGROUND

The invention relates to an apparatus and method for purging charged powder particles from a mixture of said powder particles and ferromagnetic carrier particles. Carrier particles comprising a ferromagnetic core surrounded by a thin coating are used for instance in applications such as laser printing and powder coating of substrates to transport powder particles such as toner particles and/or powdered paint particles towards a substrate on which the powder particles are to be applied. When changing powder types, for instance when changing from a black toner to a yellow toner, the batch of carrier particles used must be changed as well to avoid mixing of the earlier color with the latter color on the substrate. To reduce the number of batches of carrier particles that must be kept at hand, a number of cleaning methods have been proposed in the art. Many of these comprise cleaning the carrier particles using liquids and solvents, which are environmentally unfriendly and require the carrier particles to be dried for some time before they can be reused.

U.S. Pat. No. 6,751,430 describes a toner purging apparatus for cleaning carrier particles from charged toner particles without using a liquid. The purging apparatus comprises a roller with an outer surface to which toner laden carrier particles are attracted by means of a magnetic core placed within the roller and adapted for counter rotation with respect to the surface. A coronode wire, at a voltage having a polarity opposite to that of the charged toner particles, is arranged close to the outer surface of the roller and adapted for detoning the magnetic carrier particles by repelling the toner particles away from their laden relationship with the magnetic carrier particles and away from the coronode wire and therefore onto the outer surface. The carrier particles are then skived off the outer surface and collected in a sump.

A drawback of the known apparatus is that as the toner is separated from the carrier particles by discharge of a coronode wire, the known apparatus is not suitable for quickly purging large amounts of toner from carrier particles. Moreover, a coronode wire typically generates sparks and/or ozone, and must often be replaced due to wear.

It is an object of the present invention to provide a powder purging apparatus and method solving at least one of the drawbacks mentioned above.

SUMMARY OF THE INVENTION

According to a first aspect the present invention provides a powder purging apparatus for purging charged powder particles from a mixture of ferromagnetic carrier particles and said powder particles, comprising: a support surface comprising a first side for supporting said carrier particles; a plurality of magnets, arranged on a second side of said support surface opposite from said first side, for generating magnetic fields at said first side to attract said carrier particles to said first side for forming a magnetic brush of said carrier particles, wherein said magnetic fields and said support surface are moveable relative to each other; a driving element adapted for driving movement of said magnetic fields relative to said support surface; an attracting surface facing said first side and spaced apart there from; and a field generator adapted for generating an electrical field between said attracting surface and said support surface for attracting said powder particles towards said attracting surface. Preferably, the attracting surface is spaced apart from the magnetic brush of carrier particles, such that carrier particles may be purged without contacting the attracting surface. The maximum height of the magnetic brush may for instance be for set using a doctor blade, or a mixture supply device as described in an embodiment of the invention.

A magnetic brush of carrier particles is typically build up as a number of carrier particles stacked in a direction normal to first surface, typically forming stacks in the form of cones or bristles of carrier particles. Charged powder particles adhering to carrier particles at the outer surface of the brush are attracted to the attracting surface and purged from the carrier particles. By moving the magnetic fields relative to the first side, the magnetic fields of the magnets of the plurality of magnets in effect travel along the first side, resulting in a rearrangement of the carrier particles in the brush. Carrier particles that were previously not at the outer surface of the brush may thus be rearranged to a position at said outer surface, such that powder particles adhering thereto may be attracted away from these carrier particles towards the attracting surface.

In an embodiment, said plurality of magnets and said support surface are moveable relative to each other, and the driving element is adapted for driving movement of said support surface relative to said plurality of magnets. Preferably the driving element is adapted for driving mechanical movement of the plurality of magnets and the support relative to each other. Alternatively, when the plurality of magnets comprises electro-magnets, the driving element may be a controller for controlling the field-strengths and/or polarities of the electro-magnets relative to the support surface.

To enhance a change in magnetic field strength at the first side when the first side is moved relative to the plurality of magnets, neighboring magnets of said plurality of magnets preferably have opposite magnetic polarities and/or different field strengths, at least at the first surface. Most preferably neighboring magnets along the plurality of magnets have opposite polarities, i.e. north-south magnetic fields at said first surface. The magnets of the plurality of magnets are preferably arranged such that they provide a substantially contiguous magnetic field for attracting the carrier particles to the first side. At least half of the first side may thus be covered with carrier particles and powder particles adhering thereto.

The attracting electrical field, which may be an AC of DC electrical field, preferably has a substantially constant field strength and may be substantially continuously generated for attracting the powder particles away from carrier particles at the outer surface of the brush. As no time for charge build-up is required large amounts of powder particles may be purged from these carrier particles in a relatively short amount of time, for instance when compared to the time required for purging powder particles from carrier particles using a corona discharge device.

Moreover, the total area of a side of the attracting surface facing the first side is preferably greater than or equal to the area of the first side, such that the generated electrical field extends from substantially the entire first side to the attracting surface. Powder particles may thus be attracted away from carrier particles over substantially the entire outer surface of the brush.

In an embodiment the first side of the support surface comprises a cylindrical outer surface of a hollow body, said plurality of magnets is partitioned into a number of parallel and distinct sections at an second side of the support surface opposite from said first side, and the magnets within each section are arranged with a same magnetic pole proximate to said support surface. Preferably the hollow body is a cylindrical hollow body, or sleeve. Each of the magnets is preferably oriented with a first magnetic pole, e.g. its North pole, substantially completely facing towards the support surface, and a second pole, e.g. its South pole, substantially facing the longitudinal axis of the cylindrical outer surface and normal to said longitudinal axis.

In an embodiment the magnets are arranged for providing a magnetic force on the carrier particles over substantially the entire first side of the support surface between the starting point and the end point. Thus carrier particles on the support surface anywhere between the starting point and the end point stay attracted to the magnetic brush and supported by the support surface. To achieve this, the sections of magnets may for instance be arranged radially around the longitudinal axis of the hollow body, with neighboring sections arranged close enough to each other for attracting carrier particles, arranged on or between the neighboring sections, to the first side.

In an embodiment a distance between magnetic poles of neighboring magnets in a same section which face the second side is less than a distance between magnetic poles of neighboring magnets which are arranged in neighboring sections and which face the second side. Preferably neighboring magnets within a section substantially abut.

In an embodiment the magnetic poles of neighboring sections are oppositely directed. When the sections are moved relative to the first side this causes reversal of magnetic polarity at positions on the first surface and thus movement of carrier particles in the magnetic brush.

In an embodiment the sections of magnets extend substantially parallel to the longitudinal axis. Each of the sections thus forms a straight line of magnets having either their north or South Pole proximate to the first side of the support surface.

In an embodiment in which the support surface comprises the sleeve, or in which the first side of the support surface is the cylindrical outer surface of a hollow body, the first side is provided with a spiral for guiding movement of the carrier particles along a path having a starting point and an end point, wherein said starting point and said end point are spaced apart along said longitudinal axis.

In an embodiment, the spiral is a spiral strip comprising a first layer comprising a ferro-magnetic material, and a second layer, preferably arranged on top of the second layer, comprising or made of a substantially electrically non-conductive material. The second layer is typically fixed to the first layer using an adhesive, and both layers typically have similar widths but different heights. The strip can conveniently be attached to the first side by placing the strip with its first layer facing the first side such that the plurality of magnets hold the strip in place. The second layer, which preferably has a greater height than the first layer, substantially does not affect the electrical field between the support surface and the attracting surface. The strip can easily be removed, for instance when the first side of the support surface must be cleaned, and can be reused later on.

The spiral strip preferably has a height equal to or greater than a maximum height of the magnetic brush on the support surface.

In an embodiment, at least during purging, the support surface is arranged substantially stationary, or rotationally fixed, relative to the attracting surface, while the plurality of magnets is arranged for rotating relative to said support surface and to the attracting surface. Typically the support surface and the attracting surface are, at least during purging, fixed to a housing in a rotation fixed manner, facilitating construction of the apparatus. In this embodiment, movement of the carrier particles over the first side of the support surface is not driven by movement of the support surface, but by movement of the plurality of magnets.

In an embodiment the support surface comprises a sleeve having a longitudinal axis, wherein said first side is substantially cylindrical and arranged around said plurality of magnets and wherein said plurality of magnets extends radially from said longitudinal axis. The sleeve thus forms the support surface, and the outer side of the sleeve comprises the first side of the support surface. When the sleeve is rotated around its longitudinal axis relative to said plurality of magnets, the carrier particles are moved relative to both the sleeve and the plurality of magnets, changing the location and orientation of the carrier particles in the magnetic brush of carrier particles.

In an embodiment the magnets of the plurality of magnets are arranged substantially along a path having a starting point and an end point, wherein said starting point and said end point are spaced apart along said longitudinal axis, preferably wherein said path circumscribes the longitudinal axis multiple times and/or is directed in a single direction along said longitudinal axis. Carrier particles supplied to the first side may thus be moved substantially continuously from said starting point along said path towards the end point. Preferably, the starting point is located at a top side of the plurality of magnets, such that when said mixture falls onto the first side at said starting point, it is attracted to the support surface both by gravity and the magnetic force exerted by the plurality of magnets. Likewise, the end point is preferably located at a bottom side of the plurality of magnets, such that the force of gravity acting on carrier particles at the end point helps in letting the carrier particles escape from the magnetic field exerted by the plurality of magnets.

In an embodiment the path substantially spirals around the longitudinal axis. When the support surface is moved relative to plurality of magnets, for instance by rotating the support surface around its longitudinal axis, or by rotating the plurality of magnets around the longitudinal axis instead, the carrier particles are moved relative to said first surface along said spiraling path. During movement over said first side from said starting point towards said end point the carrier particles are thus displaced along said spiraling path, circumscribing the plurality of magnets multiple times. The positions and orientations of the carrier particles in the brush are rearranged during said movement, and the charged powder particles are subjected to the electrical attracting field over the length of said spiraling path. The purging apparatus may thus be of a compact construction while providing excellent purging capabilities.

In an embodiment said magnets of said plurality of magnets at said end point have a lower magnetic field strength than said magnets of said plurality of magnets at said starting point. Carrier particles approaching the end of the path are thus attracted with a lower magnetic force to the first side and may thus more easily be removed from the first side. Preferably the magnetic field strength at the end of the path is less than or equal to the magnetic field strength required for attracting the carrier particles to the first side during rotation of the first side relative to the plurality of magnets. In this latter case, the carrier particles may simply fall off the first side during purging when they reach the end point.

In an embodiment the path comprises a first section comprising said starting point, and a second section comprising said end point, wherein the magnetic field strengths of said magnets of said plurality of magnets arranged along said second section decrease towards the end point. As the magnetic field strengths exerted by the magnets of said second section decreases gradually towards the end point, there is no sudden change in magnetic field strength at said end point. Build up of a large body of carrier particles at said end point is thus at least substantially prevented.

In an embodiment the powder purging apparatus further comprises a carrier particle container arranged at or downstream of said end point or end portion of said path. Carrier particles which have been purged from powder particles may thus easily be collected in the carrier particle container. Preferably, the container is removeably arranged below said end point, such that it may easily be replaced by another container, for instance when filled with carrier particles. Moreover, except for at a carrier particle inlet, the carrier particle container is preferably substantially air tight, to prevent or at least substantially reduce flow of air which may carry powder particles into the carrier particle container.

In a preferred embodiment the powder purging apparatus is provided with a rotating brush close to the end point and the carrier particle container, for brushing carrier particles away from the end point and into the carrier particle container or on inlet thereof. The end point is preferably located at a fixed position on the first side of the support surface. Typically the brush is driven to rotate counter to the direction in which the carrier particles travel. The brush is preferably arranged for contacting the first side at the end point, and/or for contacting a ramped portion arranged at the end point and adapted for providing a greater distance of carrier particles at the end point from the plurality of magnets.

In an embodiment the powder purging apparatus further comprises a mixture supply device for supplying said mixture to said first side. The mixture supply device is preferably arranged above the first surface, such that said mixture may fall along with gravity from the mixture supply device onto said first side. Preferably the mixture supply device is also adapted for charging powder particles of said mixture.

In an embodiment said mixture supply device is arranged for supplying said mixture to said first side substantially at a location close to said starting point. When the mixture is only supplied at said location close to said starting point of the path, the carrier particles supplied to the starting point may be purged from powder particles during their traversal of the entire the path before reaching the end point. Moreover, further measures for purging the powder particles from the carrier particles may be arranged along the entire path except said starting point, without interfering with the supply of mixture to the support surface.

In an embodiment said mixture supply device comprises a supply outlet spaced apart from said first side by a distance substantially equal to a predetermined maximum height of said brush of carrier particles. The powder purging apparatus of the invention thus does not require a separate doctor blade or the like for limiting the height of said magnetic brush of particles. Additionally, when there is no rotational movement between the support surface and the plurality of magnets, e.g., when the drive element is inactive, the magnetic brush can build up until it substantially completely fills up the space between the supply outlet and the support surface. Once this space has been filled up, the supply outlet is blocked and no further mixture is added to the magnetic brush. The supply outlet thus also provides a dosage mechanism for preventing that an excess amount of mixture is supplied to the support surface. Preferably, the supply outlet is arranged closer to the first side than the attracting surface. More preferably, the distance of the supply outlet to the first side is adjustable. It is conceived that a mixture supply device according to this embodiment is also applicable independently in other kinds of devices in which a mixture of powder particles and ferromagnetic carrier particles is supplied to a support surface, such as powder coating devices, in particular when the mixture is fluidized.

The mixture supply device may additionally or alternatively be provided with blocking means for partially or completely blocking passage of mixture through the supply outlet. Such blocking means may for instance comprise an adjustable valve, which allows partial blocking so that the rate of flow of mixture through the outlet can be regulated. Alternatively, the blocking means may comprise a magnet moveable between a completely blocking position close to the supply outlet in which it is arranged for causing the carrier particles in the supply outlet to magnetically coalesce and thus clog the supply outlet, and a non-blocking position sufficiently spaced apart from the supply outlet such that the magnet does not cause the carrier particles to clog the supply outlet. Preferably the mixture supply device, or at least the outlet thereof, is arranged above the starting point, such that the mixture is transported along the direction of gravity from the mixture supply outlet to the starting point.

In a preferred embodiment, at least during purging, the support surface is substantially stationary, or rotationally fixed, relative to the mixture supply device or outlet thereof. Thus, during purging, the starting point and the end point remain stationary as well, facilitating deposition and removal of carrier particles on and from the support surface.

In an embodiment said mixture supply device comprises fluidizing means for fluidizing said mixture. Fluidizing the mixture allows more accurate dosage control of the amount of mixture supplied to the first side, and facilitates transportation of the mixture to the first side. Moreover, the fluidizing means may aid in providing a charge to the powder particles. German patent application DE 10 2004 046 744 A1 in particular provides details on fluidizing means suitable for use in the present invention.

In an embodiment the attracting surface comprises a plurality of openings for letting through powder particles from a first side of said attracting surface facing said support surface to a second side of said attracting surface facing away from said support surface. During purging, the powder particles may be directed through the openings in the attracting surface away from the first side of the attracting surface instead of adhering to said first side of the attracting surface. Build-up of powder particles on the attracting surface is thus limited, and the influence of said powder particles on said first side of the attracting surface on the strength of the electrical field is substantially reduced.

In an embodiment the powder purging apparatus further comprises an air manifold connected to a vacuum source, wherein said air manifold is arranged adjacent to said attracting surface for removing powder particles from said first side of the attracting surface. Powder particles are thus attracted from the first side of attracting surface into the air manifold. The air manifold is preferably arranged on said second side of the attracting surface, and preferably substantially envelops the attracting surface.

In an embodiment the apparatus further comprises an air supply comprising an air-outlet arranged substantially between the first side of the attracting surface and the first side of the support. When the air supply is activated it causes an air flow from between the first side of the attracting surface and the first side of the support to the second side of the attracting surface. When the first side of the support surface is the cylindrical outer surface of a hollow body as described above, then the air supply outlet is preferably arranged upstream of the end point with respect to the direction of movement of the carrier particles along the longitudinal axis of the cylinder. When there is little or substantially no flow of air at the end point of the path, the removal of carrier particles from the first side and/or the transport of the carrier particles from the first side to a carrier particle container can be performed more accurately.

To achieve an optimal suction effect for moving powder particles away from the attracting surface, the air supply outlet which supplies air and the air manifold which removes air, are preferably spaced apart a distance substantially equal to the distance between the starting point and the end point along the longitudinal axis.

In an embodiment said attracting surface substantially envelops said first side of the support surface. The first side of the attracting surface thus forms a tunnel around the support surface. According to this embodiment, the electrical field extends from the first side of the support surface to the attracting surface, over substantially the entire first side of the support surface. As the electrical field substantially envelops the entire first side of the support surface, charged particles may be attracted away from carrier particles at substantially the entire outer side of the brush of carrier particles.

In the embodiment in which the first side of the support is a cylindrical outer surface of a hollow body, the attracting surface is preferably also shaped substantially as cylinder with an inner diameter larger than the diameter of cylindrical first side of the support. In order to prevent the carrier particles of the magnetic brush from contacting the attracting surface, the inner diameter of the attracting surface is larger than a sum of the outer diameter of the cylindrical first side and the maximum height of the magnetic brush.

In an embodiment the powder purging apparatus the field generator is adapted for reversing the direction of the electrical field. Thus a mixture comprising ferromagnetic carrier particles and both positively and negatively charged powder particles may be purged using the apparatus of the invention. The positively charged powder particles are purged from the mixture and attracted towards the attracting surface when the attracting surface is at a negative potential relative to the support surface, and the negatively charged powder particles are purged from the mixture and attracted towards the attracting surface when the attracting surface is at a positive potential relative to the support surface. In a preferred embodiment, the direction of the field is reversed when it is determined that purging of positively charged powder particles or negatively charged powder particles is substantially complete. More specifically, the field generator is preferably adapted for generating an electrical field between the attracting surface and the support surface in a first direction for substantially half of the time required for a particle to traverse the path from the starting point to the end point, and for generating an electrical field between the attracting surface and the support surface in a second, opposite direction for the remaining half of the time required for said particle to traverse the path from the starting point to the end point. Preferably, the amount of time between reversing the direction of the electrical field is sufficient to substantially remove powder particles from the attracting surface, for instance using an air stream as may be supplied by an air manifold. For example, if it takes a substantially predetermined amount of time required for a charged particle to traverse the path from the starting point to the end point, e.g. two minutes, then the direction of the electrical field is reversed after half said predetermined amount of time has passed, i.e. after one minute.

In an embodiment said support surface and said attracting surface both comprise an electrically conductive material, e.g. stainless steel or a conductive ceramics material, wherein the field generator is conductively connected to said conductive materials of said support surface and said attracting surface and is adapted for generating a potential difference there between, preferably in the range of 1500 to 3000 Volts. The field generated extends from the first side of the support surface to the attracting surface.

In an embodiment said first side of the support surface comprises a roughened surface, e.g. grooves and/or a diamond pattern. Such a roughened surface increases the friction between the first side and the carrier particles and helps to ensure that the carrier particles move relative to both the plurality of magnets and the first side when the first side is rotated relative to the plurality of magnets, instead of remaining in a fixed position relative to the plurality of magnets. The use of a roughened or structured surface is particularly advantageous when magnets with very strong magnetic field strengths are used. In a preferred embodiment in which the first side of the support surface is the cylindrical outer surface of a hollow body, the first side is provided with a layer of a material comprising parallel ridges or edges which extend non-parallel to the longitudinal axis of the cylindrical first side. In this embodiment, the height of the ridges or edges is preferably substantially less than the maximum height of the magnetic brush. Thus, during use of the device, the carrier particles of the magnetic brush are urged to move along the direction of the grooves or edges, but may also move across and over the ridges or edges, for instance when the path along the ridges or edges is (temporarily) blocked. In a specific embodiment the ridges and/or edges form a number of substantially parallel spirals on the first side of the support surface, for guiding the carrier particles along one or more spiraling paths along the longitudinal axis of the cylindrical outer surface. The layer of material preferably comprises a substantially non-electrically conductive material, e.g. a plastic.

In an embodiment said driving element is adapted for driving rotational movement of said support surface relative to said plurality of magnets, preferably at a speed of 100 rpm, or more, more preferably at a speed of 100 to 500 rpm. Preferably, the rotational movement is a rotational movement around the longitudinal axis of the support surface.

In an embodiment the support surface is moveable from a first position in which said plurality of magnets is arranged for generating said magnetic field at said first side for attracting said carrier particles to said first side, to a second position in which said first side is substantially outside the magnetic field generated by said plurality of magnets, and vice versa. Carrier particles may be removed from the support surface by moving the support surface to the second position. Moreover, maintenance and/or cleaning of the first side of the support surface is facilitated when in the second position.

In an embodiment, at least during use, said attracting surface is substantially rotationally fixed relative to said plurality of magnets or said support surface. When the attracting surface is rotationally fixed relative to the plurality of magnets, the driving element only has to drive movement of the support surface, which usually comprises less mass, even when supporting the magnetic brush of carrier particles, than the plurality of magnets. Preferably, the plurality of magnets is also substantially rotationally fixed relative to the mixture outlet and/or the carrier particle container of the purging apparatus. When the attracting surface is rotationally fixed relative to the support surface, the purging apparatus comprises substantially no moving parts between the first side of the support surface and the first side of the attracting surface.

According to a second aspect the present invention provides a method of purging charged powder particles from a mixture of ferromagnetic carrier particles and said powder particles, said method comprising: supplying said mixture to a first side of a support surface; attracting said carrier particles of said mixture to said first side using a plurality of magnets arranged on a second side of said support surface opposite to said first side to generate magnetic fields to form a magnetic brush of said carrier particles on said first side; moving said magnetic fields relative to said support surface; and generating an electrical field between said support surface and an attracting surface spaced apart from and facing said first side for attracting said charged powder particles.

In an embodiment the method is carried out using a powder purging apparatus as described herein.

In an embodiment, at least during purging, said support surface is rotated relative to said plurality of magnets. Preferably, the attracting surface is also spaced apart from the magnetic brush of carrier particles. Rotation of the support surface causes the carrier particles to be displaced relative to said first side, such that carrier particles may move to and from an outer surface of the brush of carrier particles. Charged powder particles adhering to carrier particles at the outer surface of the brush are attracted away from the carrier particles towards the attracting surface, resulting in purging of these powder particles from the carrier particles.

In an embodiment, at least during purging, the attracting surface is substantially rotationally fixed relative to said support surface while movement of said plurality of magnets is driven relative to the support surface.

In an alternative embodiment, at least during purging, the attracting surface is substantially rotationally fixed relative to said plurality of magnets. In this embodiment, preferably both the attracting surface and the plurality of magnets remain substantially stationary during purging, while the support surface is rotated relative to the plurality of magnets.

In an embodiment the method further comprises a step of fluidizing said mixture prior to supplying said mixture to said first side of the support surface.

In an embodiment the first side has a cylindrical shape and said carrier particles are moved relative to said first side by rotating first side relative to said plurality of magnets.

In an embodiment the magnets of said plurality of magnets are arranged substantially along a spiraling path having a starting point and an end point, wherein the starting point and the end point are spaced apart along a longitudinal axis of said cylindrical shape, wherein said mixture is substantially continuously supplied to said first side at said starting point, and wherein said carrier particles on said first side are substantially continuously moved over said first side along said spiraling path towards said end point. The invention thus provides a method for substantially continuously purging charged powder particles from a mixture of said powder particles and carrier particles, in which carrier particles are purged in a single traversal along the spiraling path, and may be collected at the end of said path.

In an embodiment the magnetic field strength of said magnets decreases towards said end point, allowing easy release of the carrier particles from the first surface at said end point.

In an embodiment the method further comprises the step of reversing said electrical field. A mixture comprising ferromagnetic carrier particles and both positively charged and negatively charged powder particles may thus be purged using the method according to the invention. During purging, the electrical field is preferably in a first direction for half of the time required for purging a carrier particle, and in a second direction opposite to the first direction for the remaining half of the time required for purging a carrier particle.

In an embodiment, the method comprises the additional step of placing a substrate to be provided with said powder particles between the attracting surface and the first side, spaced apart from said first side. Preferably, in this embodiment, the first side of the support surface is substantially planar and remains substantially stationary relative to the substrate, and the plurality of magnets is rotated relative to the support surface around an axis of rotation normal to the planar first side. The powder particles are thus applied evenly to the substrate while the carrier particles are purged from said powder particles. The substrate is preferably spaced apart from said brush of carrier particles.

In an embodiment, the attracting surface comprises a substrate to be provided with said powder particles. Preferably in this embodiment the first side of the support surface is substantially planar and remains substantially stationary relative to the substrate during purging, and the plurality of magnets is rotated relative to the support surface around an axis of rotation normal to the planar first side. The substrate is preferably also spaced apart from said brush.

In an embodiment substantially all of said mixture is supplied to said first side, wherein said mixture comprises a substantially predetermined amount of powder particles. The method thus provides a way to apply a precisely defined amount of powder to a substrate while purging the powder from the carrier particles. In this embodiment, the powder particles are preferably purged from the carrier particles until substantially all powder particles have been purged from the carrier particles. It may be determined that substantially all powder particles have been purged by letting the purging method last for a predetermined amount of time, for instance based on the predetermined amount of powder particles. Alternatively, the powder purging apparatus may comprise an optical sensor arranged for detecting movement of powder particles attracted away from the magnetic brush and moving towards the substrate, and it may be determined that substantially all powder particles have been purged from the carrier particles when said sensor has detected no such movement of for a predetermined amount of time. In yet an other alternative embodiment it is determined whether substantially all of the powder particles have been purged from the carrier particles by measuring the weight of the substrate and/or the mixture on said first side during purging, and comparing said measured weight with said predetermined amount of powder particles.

In summary the invention provides an apparatus and method for purging charged powder particles from a mixture of said powder particles and ferromagnetic carrier particles. Purging is effected by moving the carrier particles relative to a first side of a support surface which supports said carrier particles, while attracting the powder particles towards an attracting surface which is spaced apart from said support surface and at a different potential than said support surface.

The movement of the carrier particles is driven by moving the support surface relative to a plurality of magnets which are arranged on a second side of the support surface opposite to said first side, for attracting the carrier particles to said first side.

The various aspects and features described and shown in the specification can be applied, individually, wherever possible. These individual aspects, in particular the aspects and features described in the attached dependent claims, can be made subject of divisional patent applications.

DETAILED DESCRIPTION OF THE INVENTION

In laser printers or coating apparatuses, in particular powder coating apparatuses, ferromagnetic carrier particles are often used to transport smaller non-magnetic powder particles to a surface to be provided with said powder particles for the development of an image on said surface and/or providing a layer of powder particles on said surface. However, even after such an image or layer has been formed on the surface, typically a residue of powder particles remains which sticks or adheres to said carrier particles. In order to be able to reuse the carrier particles with a different kind of powder particle, e.g. when using the same carrier particles with powder particles of a different color, the powder particles must be purged from the carrier particles.

Figure 1:
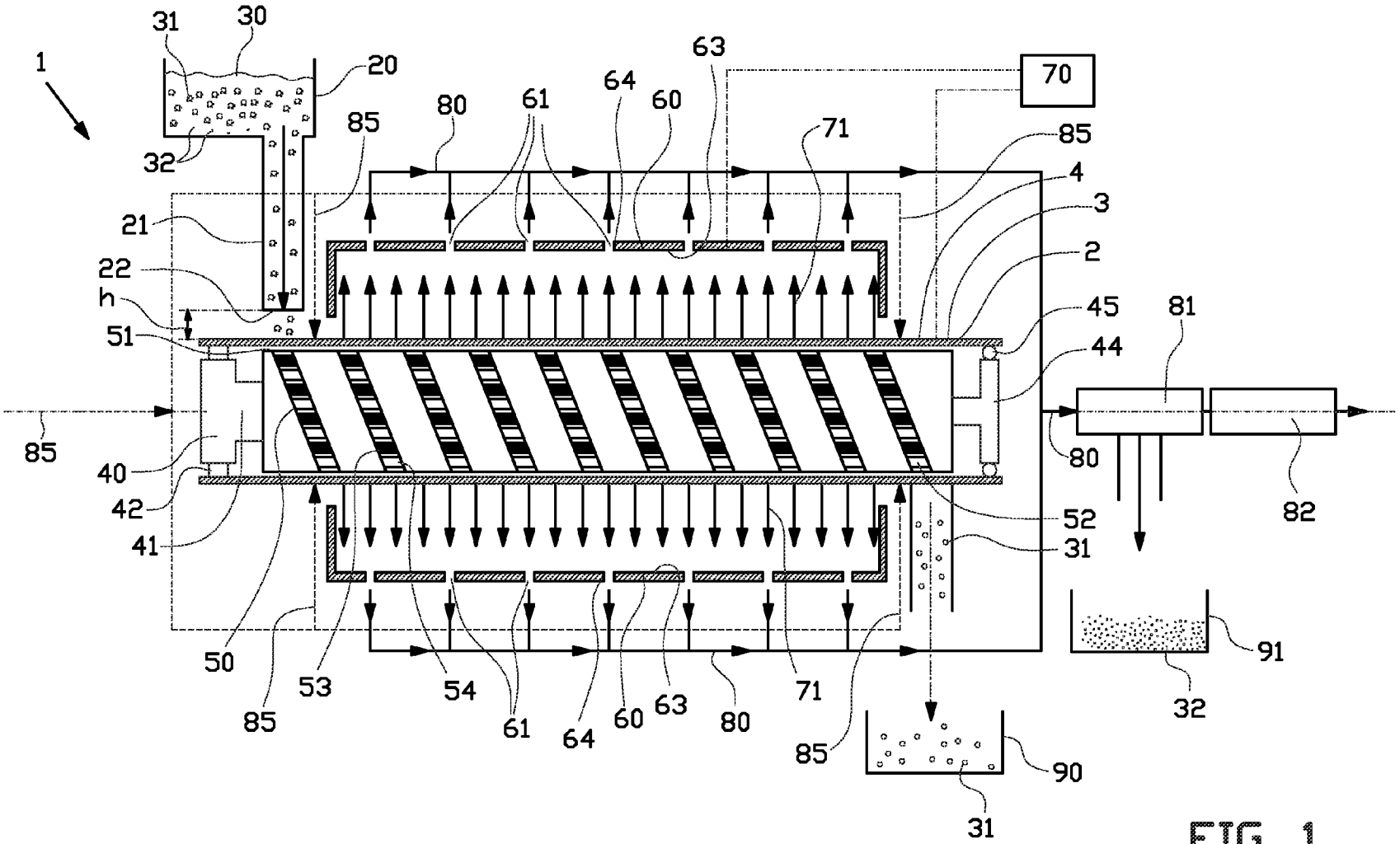
FIG. 1 schematically shows a cross-sectional view of a powder purging apparatus according to a first embodiment of the invention, FIG. 2A schematically shows a partial side view and cross-sectional view of a powder purging apparatus according to a second embodiment of the invention, FIG. 2B schematically shows a cut-open section of the apparatus of FIG. 2A, FIG. 3 schematically shows a path followed by carrier particles in an apparatus according to the invention, FIG. 4A schematically shows a cross-sectional side view of a further embodiment of the invention, FIGS. 4B and 4C schematically show a cross-sectional front view of the embodiment of FIG. 4A.

FIG. 1 schematically shows a cross-sectional view of an apparatus 1 for purging powder from charged particles according to the present invention. The powder purging apparatus 1 comprises a mixture supply device 20 containing a mixture 30 of ferromagnetic carrier 31 particles and charged powder particles 32, wherein the powder particles typically adhere to the carrier particles.

The mixture supply device 20 supplies the mixture through a mixture supply outlet 21 having an open end 22, towards a cylindrical support surface, or sleeve 2. The cylindrical support surface comprises a first side 3 for supporting said carrier particles 31 thereon. Any powder particles 32 adhering to the carrier particles are supported on the first side 3 as well. On a second side 4 of the support surface 2, which is a side of the support surface opposite to the first side 3, a plurality of magnets 50 is arranged in a spiraling path around longitudinal axis L of the cylindrical support surface 2. The magnets are arranged along said spiraling path, facing the first side 3 with alternating north-south polarities, i.e. any two neighboring magnets 53, 54 along said path have opposite polarities facing the first side. The magnets are arranged proximate to and spaced apart from the first side 3 and generate a magnetic field for attracting the ferromagnetic carrier particles 31 to the first side 3 for forming a magnetic brush of carrier particles in a manner known in the art. A maximum height of the brush is determined by the distance h between the open end 22 of the supply outlet 21 to the first side 3; because a brush can be formed of a height at most equal to said distance no doctor blade is required for limiting the maximum height of the brush.

The cylindrical support surface 2 is arranged as a sleeve around the plurality of magnets 50. An electromotor 40 is adapted for driving rotation of the support surface 2 around the plurality of magnets 50. The electromotor comprises a stator 41, which supports the plurality of magnets 50 at a first and, and a rotor 42, which supports the support surface 2 at a first end. The plurality of magnets is supported at a second, opposite end by support 44, and the cylindrical support surface 2 is supported at a second opposite end by bearings 45.

When the support surface 2 rotates around the plurality of magnets 50, the magnets continue to attract the carrier particles 31 to the first side, which, in combination with friction between the carrier particles 31 and the first side 3 due to rotation of the support surface 2 around the plurality of magnets 50, drives movement of the carrier particles over the first side 3. The movement of the carrier particles 31 and any powder particles 31 adhering thereto over the first side 3 of the support surface substantially follows the spiraling path along which the magnets of the plurality of magnets 50 are arranged from a starting point 51 of said path to and end point 52 of said path. During purging, the plurality of magnets 50 remains stationary relative to the supply outlet 22. The supply outlet may thus be arranged to supply carrier particles to said sleeve 2 at the position of the starting point of the path. During said movement of the carrier particles 31 along the spiraling path of the plurality of magnets 50, the ordering between the carrier particles 31 in the magnetic brush of changes as well, such that carrier particles that were first at the interior of the of the brush may move to the exterior of the brush and vice versa, and the orientation of the carrier particles relative to the first side may change as well. As a consequence, powder particles adhering 32 to the carrier particles 31 will eventually be located at the outer side of the brush where they may relatively easily be separated from the carrier particles 31.

For separating charged powder particles from carrier particles, the purging apparatus further comprises a stationary attracting surface 60, spaced apart from said first side. The purging apparatus further comprises a field generator 70 for generating an electrical field 71 between the support surface 2 and the attracting surface 60. In the embodiment shown, both the support surface 2 and the attracting surface 60 comprise a conductive metal. The field generator 70 generates the electrical field 71 between the attracting surface and the support surface by providing a potential difference between the attracting surface 60 and the support surface 2 of 1500 to 3000 Volts. Preferably, the support surface is at a voltage of 2000 Volts while the attracting surface 60 is grounded. Charged powder particles 32 at the exterior of the brush are attracted towards the attracting surface 60 and are thus purged from the carrier particles 31.

In the embodiment shown, the charged powder particles 31 are positively charged powder particles, and the electrical field 71, which is normal to the support surface 2, attracts positively charged powder particles in the direction of the field 71 away from the support surface 2 and towards the attracting surface 60. If the mixture 30 would have comprised negatively charged powder particles instead of positively charged powder particles, the direction of the electrical field would have been reversed. Because the field generator 70 is adapted for providing an electrical field in a first direction 71, and in an opposite second direction, the apparatus 1 may also be used to purge a mixture comprising ferromagnetic carrier particles and both positively and negatively charged powder particles. In such a case the field generator 70 would be configured for reversing the direction of the electrical field after half the time required for a carrier particle to traverse the path from the starting point 51 to the end point 53 has passed, such that during half the traversal of the path by the carrier particles the positively charged powder particles are purged from the carrier particles, and such that during traversal of the remaining half of the path by the carrier particles the negatively charged powder particles are purged from the carrier particles.

To reduce the build-up of powder particles 32 at the attracting surface 60, which would influence the electrical field, the attracting surface 60 is provided with a plurality of apertures 61 through which the powder particles 32 can pass from a first side 63 of the attraction surface facing the first side 3 of the support surface 2, to an opposite second side 64 of the attracting surface. At the second side 64, the attracting surface 60 is connected to an air manifold 80 which in turn is connected to a vacuum pump 82. The air manifold 80 supplies the air containing the powder particles to an air filter 81 placed between the vacuum pump and the air manifold 80. To improve the flow of air for transporting the powder particles away from the first side of the attracting surface, a stream of fresh air is supplied between the first side 3 of the support surface 2 and the first side of the attracting surface. The vacuum pump 82 causes an under pressure at the second side 64 of the attracting surface 60, which causes air and the powder particles at the first side to move through the apertures 61 towards the second side and then towards the air filter 81. The filtered powder particles 32 are deposited in a powder container 82.

When carrier particles 31 have been purged once they traveled along the spiraling path from the starting point 51 to the end point 52, they are removed from the first side of the support surface and collected in a carrier particle container 90. To remove the carrier particles from the first side at the end of the path a skive may for instance be used. In the embodiment shown however, the magnetic strengths of the magnets of the plurality of magnets decreases along the path towards the end 52 of the path. At end point 52 the force exerted by the magnets on the carrier particles attracting the carrier particles towards the first side 3 is less than the force of gravity and/or friction caused by rotation of the circumferential surface directed away from the first side 3. As a result, purged carrier particles which have reached the end 52 of the path fall into carrier particle container 90.

Figure 2A:
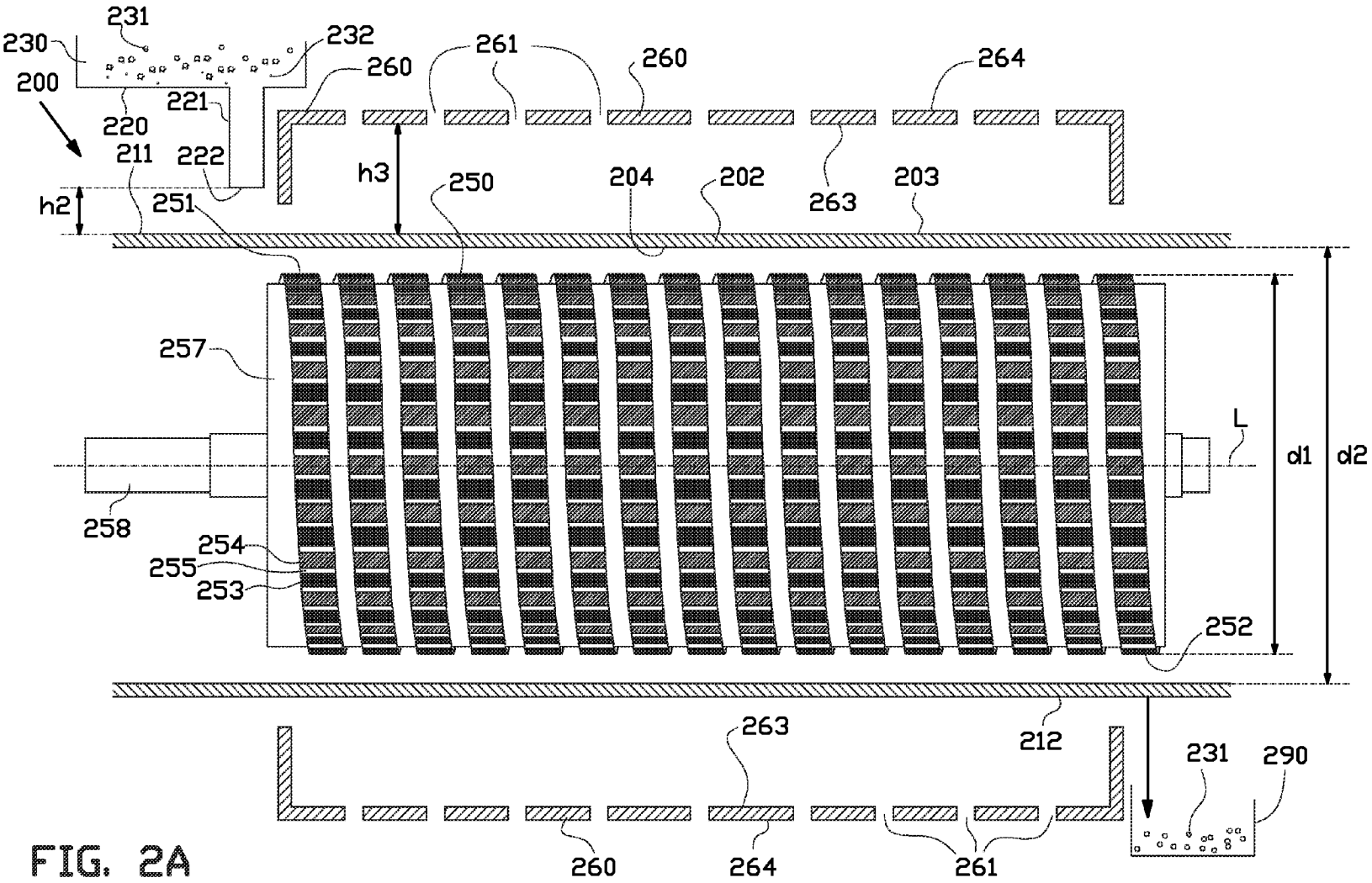

FIG. 2A shows a side view of a cylinder 200 on which a plurality of magnets 250 as used in an embodiment of the invention is arranged. The plurality of magnets 250 is arranged on a cylindrical body 257, along a spiraling path having a starting point 251 and an end point 252. The magnets of the plurality of magnets 50 are arranged such that neighboring magnets along the path have opposite polarities, at a side of the plurality of magnets facing away from the cylinder 257, i.e. the magnets depicted in black, such as magnet 253 are facing outward with their south poles, and their neighboring magnets depicted in white, such as magnet 254, are facing outward with their north poles. Neighboring magnets are spaced apart along the path using spacing elements 255. For comparison, a schematic cross-section of a cylindrical support surface 202 or sleeve for supporting a magnetic brush of carrier particles on a first side 203 thereof is shown as well, together with a supply device 220 containing a mixture of carrier particles 231 and charged powder particles 232. The supply device comprises a supply outlet 221 arranged with its end 222 at a distance h2 from the first side of the support surface 202. The first side 263 of the attracting surface 260, is spaced apart from the first side 203 of the support surface 202 by a distance h3 which is greater than the distance h2, such that the magnetic brush of carrier particles formed on the first side of the support surface when the carrier particles are supplied thereto cannot not contact the first side 263 of the attracting surface 260. The attracting 260 surface comprises apertures or through holes 261, allowing air and powder particles to pass from the first side 263 of the attracting surface facing the first side of the support surface 202 to the oppositely facing second side 264 of the attracting surface. The outer diameter d1 of the spiral in which the plurality of magnets 50 is arranged is smaller than an inner diameter d2 of the support surface 202, such that the support surface 202 may rotate substantially freely relative to the plurality of magnets 50. Preferably during purging, the plurality of magnets 50 remains substantially stationary, while an electromotor drives rotation of the support surface 202 around the plurality of magnets 250. In this manner the position of the start 251 of the path relative to the end 222 of the supply outlet 221 remains substantially constant, and the position of the end 252 of the path relative to a carrier particle container 290 remains substantially constant as well. However, in an alternative embodiment, an electromotor may be used to drive rotation of the plurality of magnets within the circumferential surface 202 while the circumferential surface remains substantially stationary, or one or more motors may be provided for driving rotation of both the circumferential surface 202 and the plurality of magnets 250.

Figure 2B:
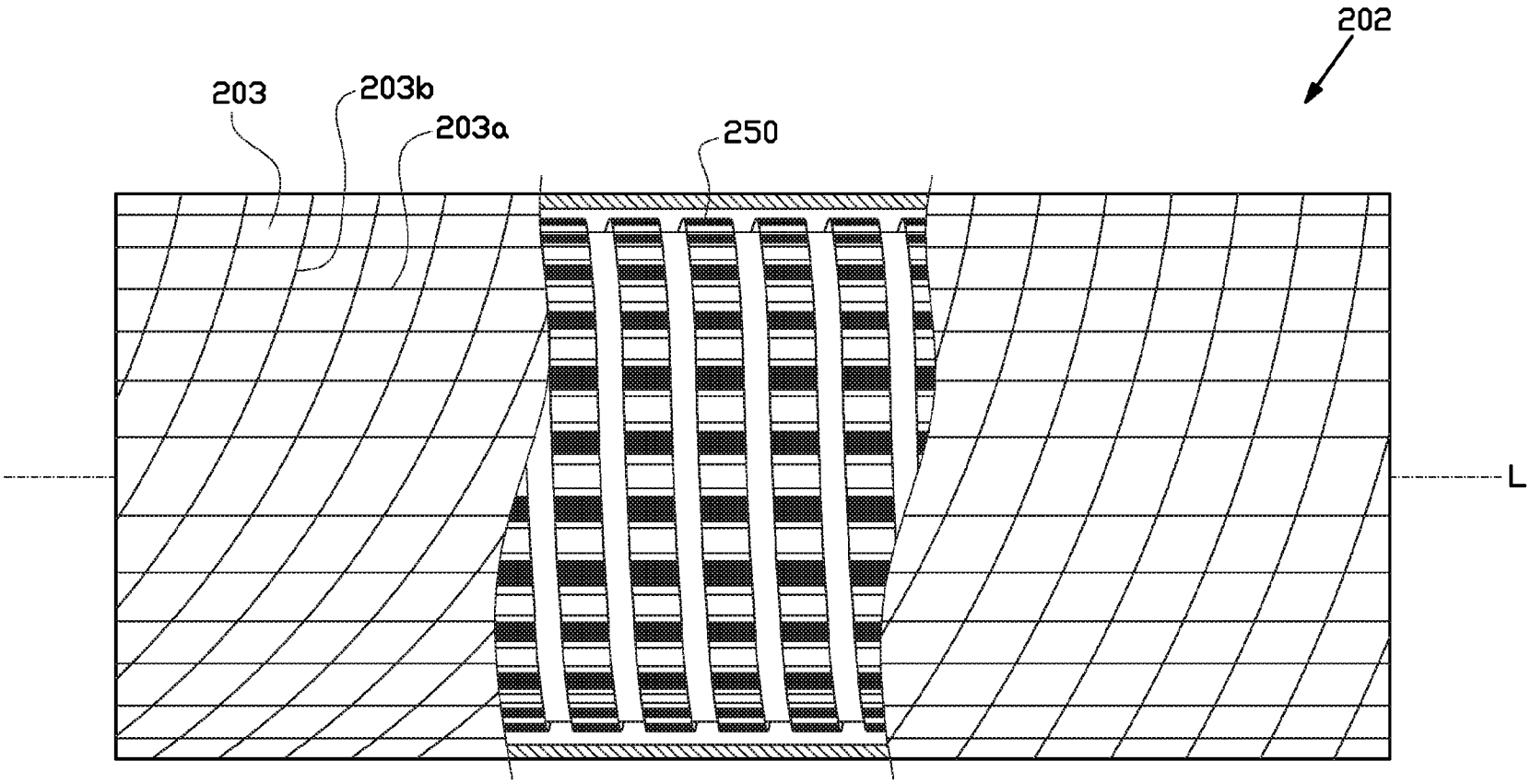

FIG. 2B shows a cut-out side view of the sleeve 202 of FIG. 2A. The first side 203 of the sleeve is provided with a number of grooves 203*a* extending substantially parallel to the longitudinal axis L of the sleeve, and a number of elliptical grooves 203*b* substantially circumscribing the first side 203. The grooves 203*a* and 203*b* on the first side provide additional friction with the carrier particles when the support surface 202 is rotated relative to the plurality of magnets 250. The additional friction helps in driving displacement of the carrier particles over the first side when the support surface rotates around the plurality of magnets. Moreover, scraping of the carrier particles against each other and the first side, in particular against the grooves 203*a*,203*b* of the first side, helps in loosening powder particles from carrier particles to which they are attached.

Figure 3:
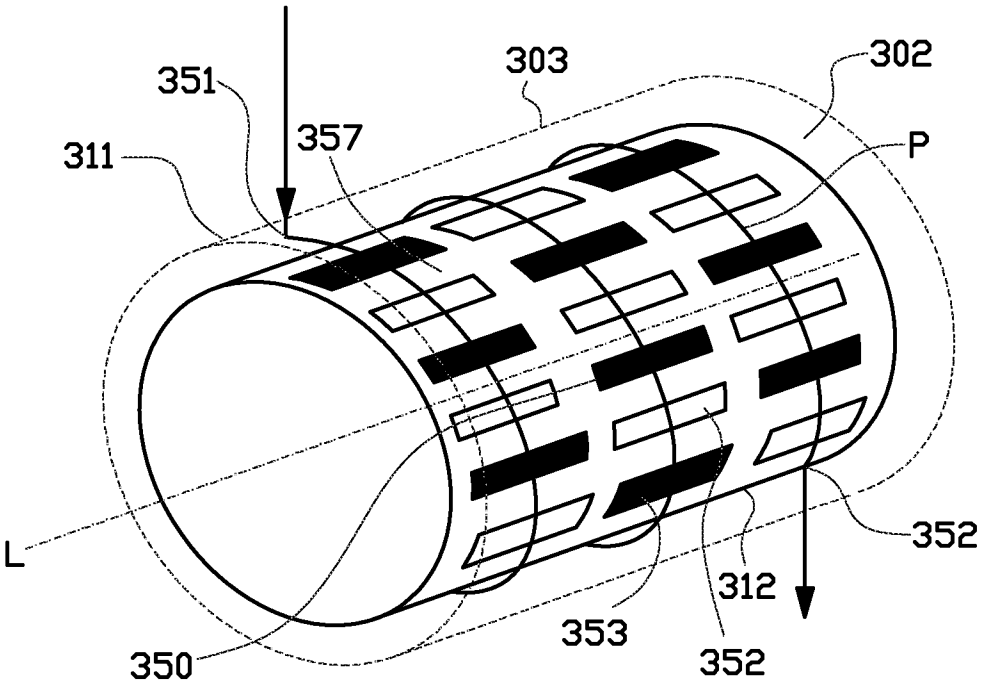

FIG. 3 schematically shows a path P followed by carrier particles over a cylindrical support surface 302. A mixture of ferromagnetic carrier particles and charged powder particles is supplied onto a first side 303 of the cylindrical support surface 302 at or close to a starting point 351 a plurality of magnets 350 which are arranged spiraling over the outer side of cylinder 357. The spiraling path P spirals around the longitudinal axis L of the cylinder from said starting point to an end point spaced apart from the starting 351 point along the longitudinal axis L. Neighboring magnets of the plurality of magnets 350 along said path having opposite polarities at the first side. When a mixture of ferromagnetic carrier particles and substantially non-magnetic powder particles is supplied to the first side and the support surface 302 rotates relative to the plurality of magnets 350, the carrier particles are driven along the path in a direction from the starting point to the end point of the path.

Figure 4A:
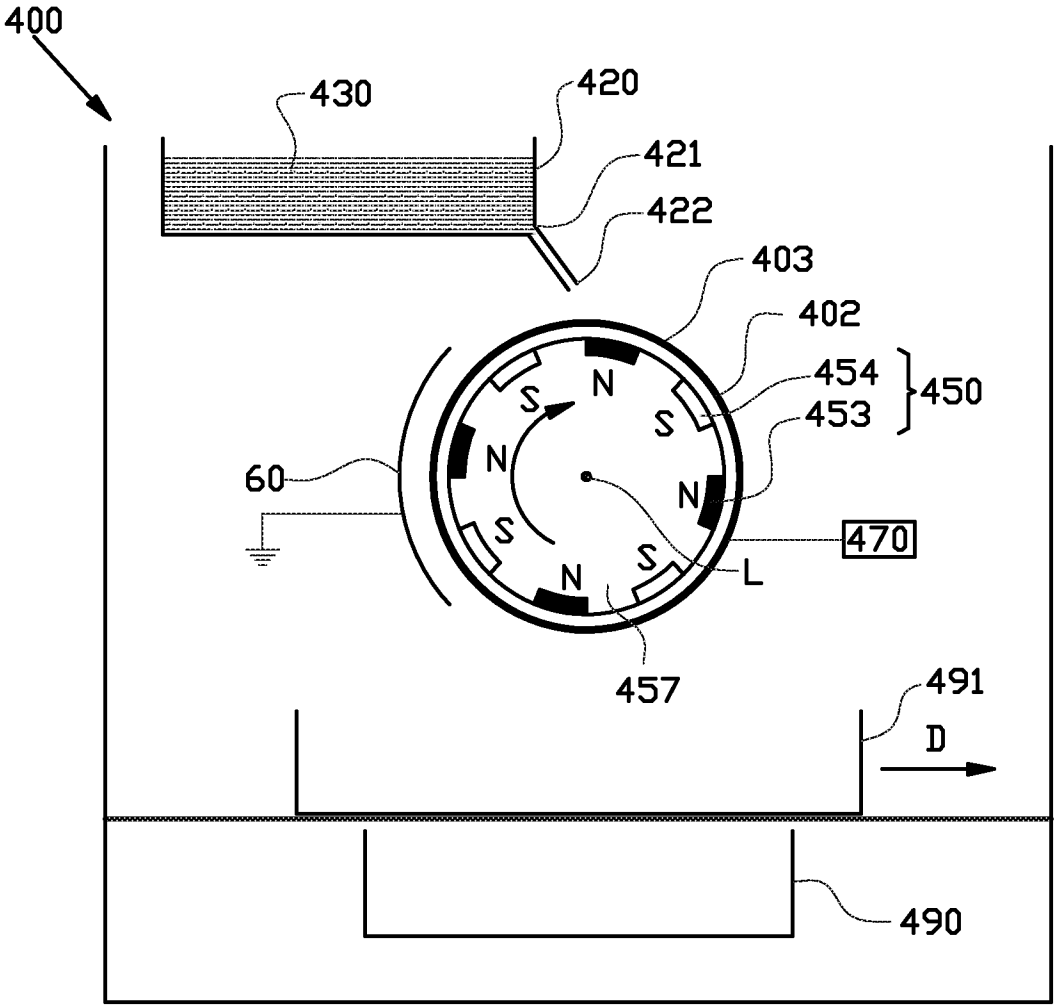

FIG. 4A shows a cross-sectional side view of an embodiment of the present invention. Powder purging apparatus 400 comprises a support surface or sleeve 402 having a first side 403 for supporting a mixture 430 of ferromagnetic carrier particles and charged powder particles supplied from an end 422 of a supply outlet 421 of a supply device 420. When the mixture is supplied to the support surface it forms a magnetic brush of carrier particles thereon under the influence of the magnetic field exerted by plurality of magnets 450. The apparatus further comprises a powder container 491 and carrier particle container 490 here shown in a position these containers would be in during purging of powder from the carrier particles. The plurality of magnets 450 of the apparatus is rotatable relative to the support surface 402 around an axis of rotation L. The rotation causes carrier particles in the magnetic brush to change position and orientation within the brush, such that different carrier particles and different parts thereof are presented at the exterior of the brush. Electrical field generator 470 applies a potential to the support surface 402, such than an electrical field is generated between the support surface 402 and an attracting surface 460 which is a ground potential. The electrical field attracts charged powder particles located at the exterior of the magnetic brush away from the carrier particles, thus purging the carrier particles from the powder particles. Charged powder particles that have been attracted away from the magnetic brush may fall along with gravity into powder container 491, while the carrier particles remain on the support surface during purging.

Figure 4B:
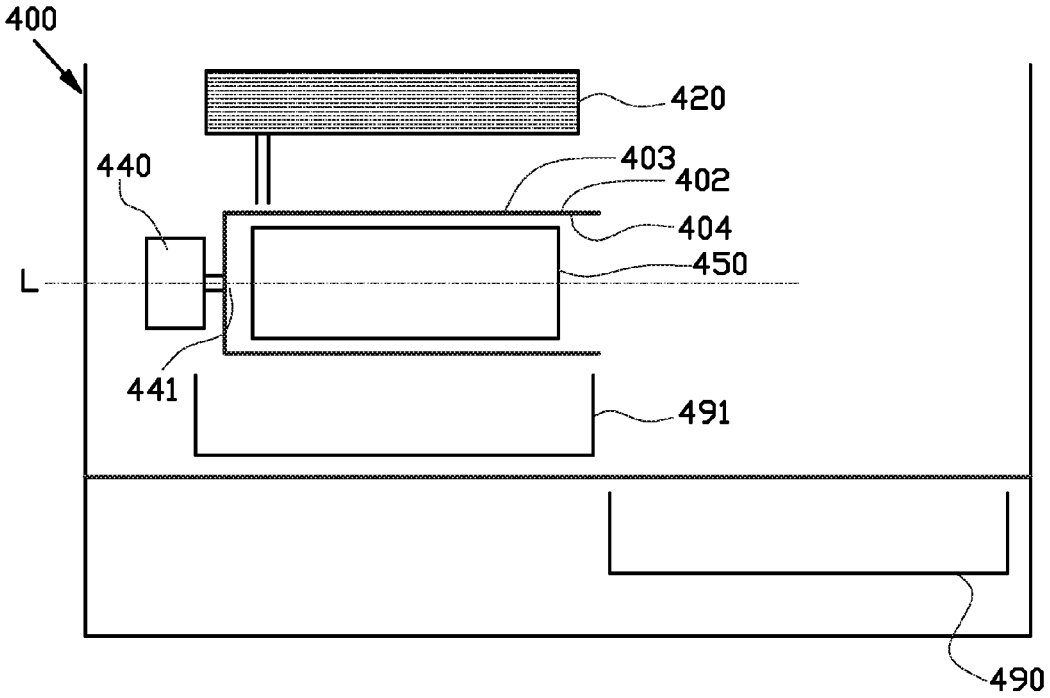

FIG. 4B shows a cross-sectional front view of the apparatus of FIG. 4A. A shaft 441 connects the plurality of magnets 450 to a motor 440 for driving rotation of the plurality of magnets around its axis of rotation L.

When purging is complete, substantially only the carrier particles are left on the sleeve 402. During purging it may be determined that purging is complete by determining whether or not there is a transfer of powder particles from the sleeve into the powder container 491, for instance using a scale for weighing the mass of the powder sump, using an optical detector for optically determining whether particles are transferred into the powder sump, or by detecting whether there is a change in potential of the attracting surface 460 due to charged powder particles contacting said attracting surface, and/or by setting a time limit for purging.

Figure 4C:
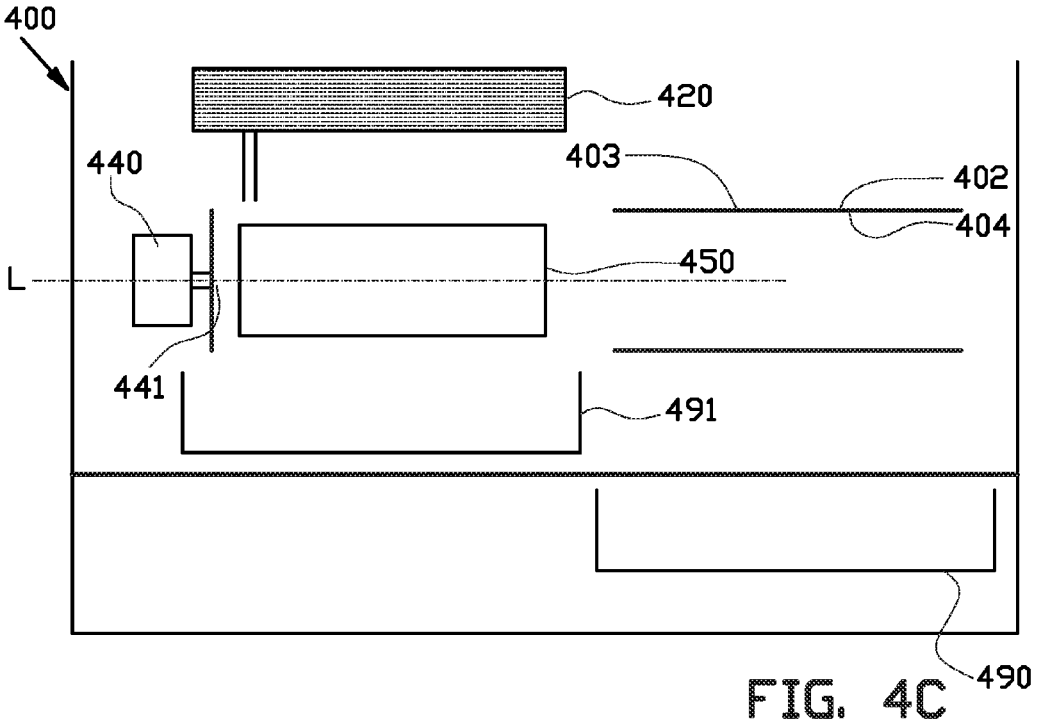

When it is established that purging is complete, the support surface 2 is moved from a first position, in which said magnets of said plurality of magnets are proximate to said first side as shown in FIG. 4BA, to a second position, in which said first side is substantially outside the magnetic field generated by said plurality of magnets as shown in FIG. 4C. In this latter case, when the sleeve or receiving surface 2 is slid in a direction away from the plurality of magnets 450 along the axis of rotation L, the plurality of magnets 450 no longer attract the carrier particles towards the sleeve 402, as a result of which the carrier particles are free to fall into carrier particle container 490 located below the sleeve when the sleeve is in the second position. Preferably the powder container 491 is removed from the purging apparatus prior to moving the support surface to the second position.

Figure 5B:
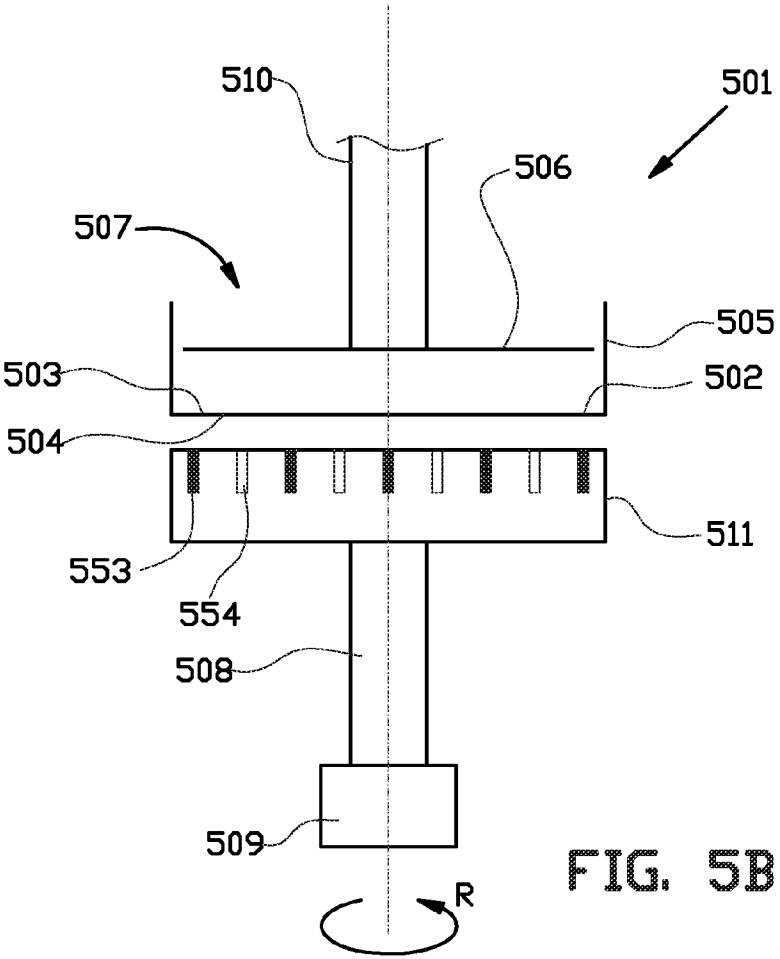
FIG. 5B shows a cross-sectional view of an apparatus of FIG. 5A during use.
Figure 5A:
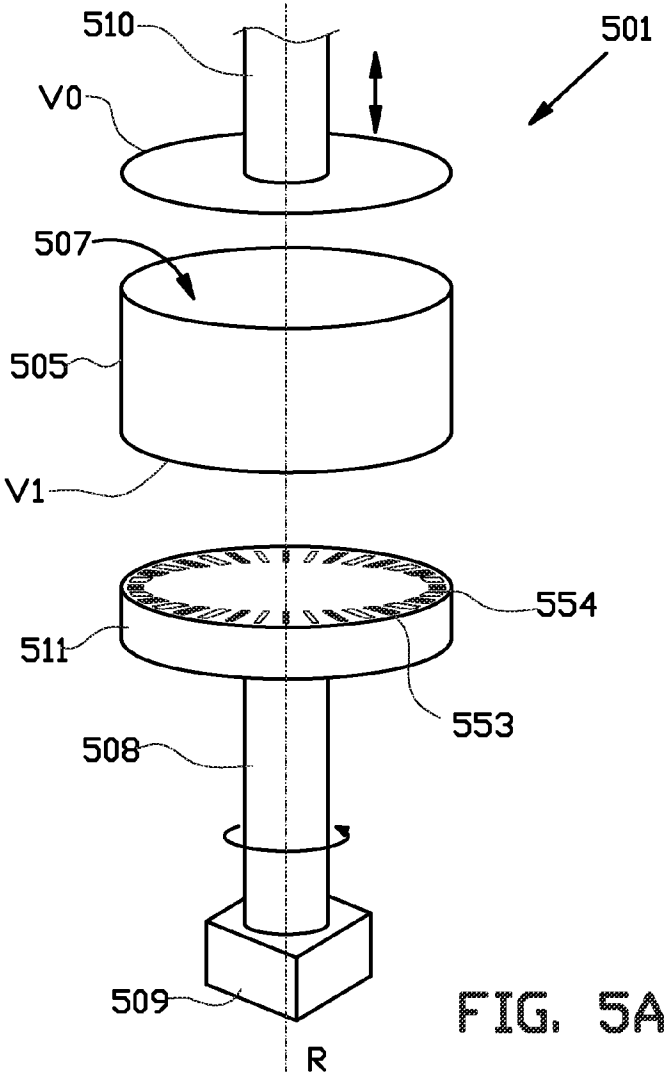
FIG. 5A shows an exploded isometric view of a powder purging apparatus according to the invention, adapted for applying a predetermined amount of powder to a substrate.

FIGS. 5A and 5B schematically show an exploded view and a cross-sectional view of an alternative embodiment of the present invention. During use, a mixture of carrier particles and powder particles is placed in a container 507, which comprises a support surface 502 having a first side 503 for supporting said mixture thereon. A disc 511 comprising a plurality of magnets 553,554 arranged radially around the center of the disc is provided on a side 504 of the support surface 102 facing away from said first side 503. The disc is 511 connected via a shaft 508 to a motor 509, for rotating the disc around an axis of rotation R. The apparatus further comprises an attracting surface 506, which is connected to a shaft 510, and moveable parallel to the axis of rotation R, for positioning the attracting surface closer to or further away from the mixture in the container 507. The attracting surface 506 is at a first potential V0 and the first side 503 is at a different, second potential V1. The electrical field thus generated between the attracting surface and the first side causes the powder particles to be attracted towards the attracting surface 506. The ferromagnetic carrier particles remain attracted to the first side 503 by the magnetic force exerted on the carrier particles by of the plurality of magnets of the disc 511. The attracting surface preferably comprises a surface to be coated with a layer of powder particles. In use, the disc 511 is rotated while a potential difference is applied between the first side 503 and the attracting surface 506, until substantially all powder particles have been purged from the carrier particles and attracted onto the attracting surface 506. The embodiment thus allows coating of a surface to be coated with a precisely predetermined amount of powder particles.

Figure 6:
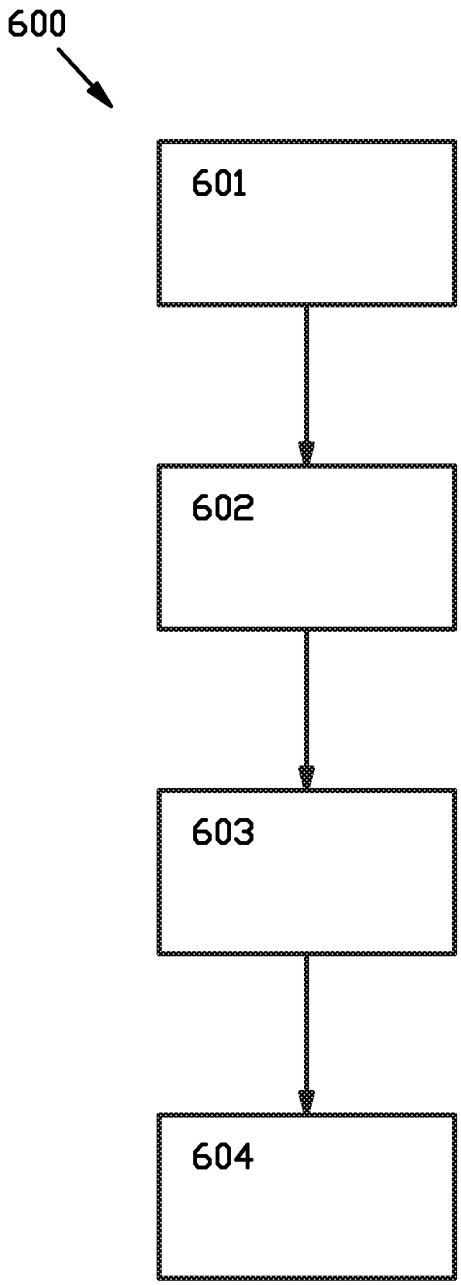
FIG. 6 shows a flow chart of a method for purging powder particles from a mixture of and ferromagnetic carrier particles and charged powder particles according to the present invention, FIGS. 7A and 7B schematically show cross-sectional views of a preferred embodiment of powder purging apparatus according to the present invention, FIG. 7C schematically shows an isometric exploded view of a portion of the powder purging apparatus of FIG. 7A, including a cylindrical support surface provided with a spiral on its first side and a plurality of magnets is arranged on a roll which is rotatable relative to and arranged within the cylindrical support surface.

FIG. 6 shows a flow chart of steps of the method according to the present invention. At step 601 a mixture of ferromagnetic carrier particles and powder particles adhering thereto is supplied to a first side of a support surface. At step 602 the ferromagnetic carrier particles are attracted to the first side using a plurality of magnets arranged on a second side of said support surface opposite to the first side, such that a magnetic brush of carrier particles is formed on said first side. The support surface is rotated relative to the plurality of magnets at step 603, such that the position and orientation of carrier particles within the magnetic brush changes, and different carrier particles and parts thereof are arranged at the outer surface of the brush. At step 604 an electrical field is applied between the support surface and an attracting surface which is space apart from the support surface, such that powder particles are attracted away from the outer surface of the brush towards the attracting surface. As a result, the carrier particles are purged from powder particles. Though steps 601-604 are here shown in sequential order, it will be appreciated that they may be performed substantially at the same time.

Figure 7A:
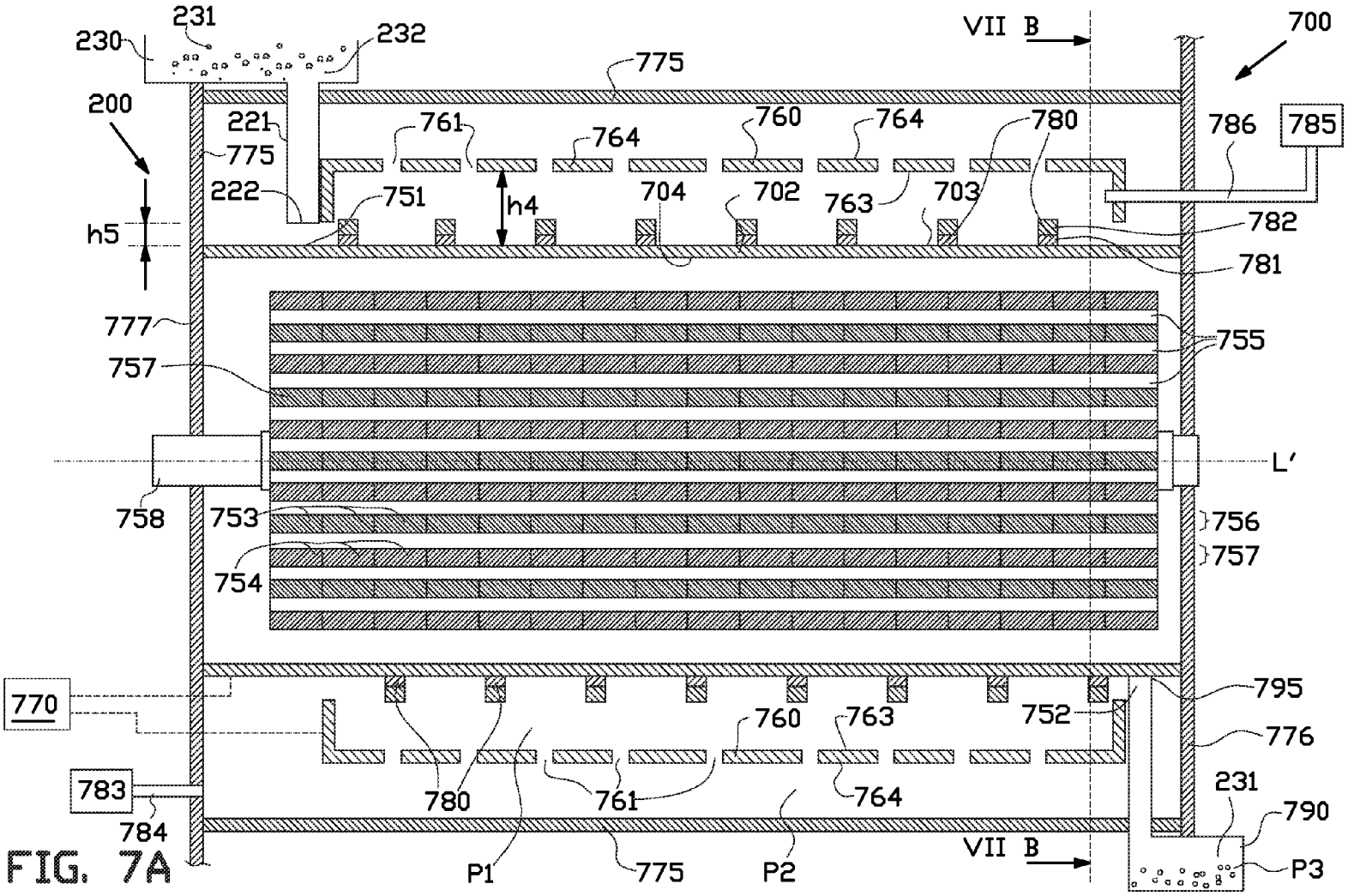
Figure 7B:
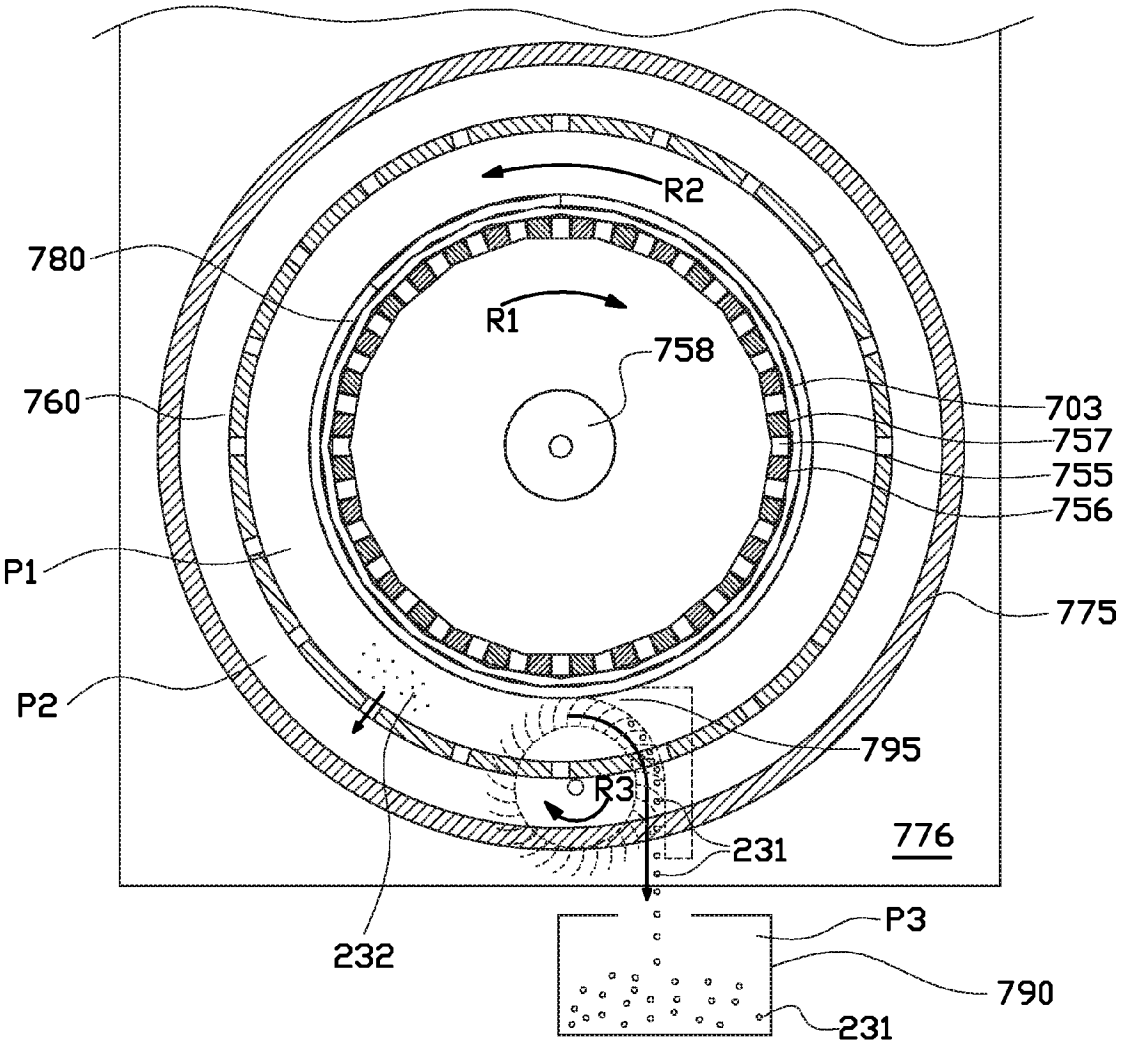

FIG. 7A schematically show a cross-sectional view of a powder purging apparatus 700 according to a preferred embodiment, and FIG. 7B schematically shows a cross-sectional view along line VIIB-VIIB of FIG. 7A.

The apparatus 700 comprises a hollow support cylinder 702 for supporting on a first side 703 (or outer surface) thereof a magnetic brush (not shown) of ferromagnetic carrier particles. During purging, the support cylinder 702 remains substantially rotationally fixed to attracting surface 760 and housing 775,776,777. Because the attracting surface substantially entirely envelopes the first side 703 of the support surface 702 (see also FIG. 7B), a relatively large and homogeneous electric field can be generated between the support surface 702 and the attracting surface 760, so that substantially independent on the position of a powder particle in the magnetic brush the electric field exerts a force on the powder particle for moving the powder particle towards the attracting force.

The support cylinder 702 is a metal support cylinder, and the attracting surface 760 is a metal attracting surface which also is substantially cylinder-shaped and substantially surrounds the metal support cylinder and is spaced apart therefrom by distance h3 greater than the maximum height of the magnetic brush. Field generator 770 is adapted for generating an electrical field between the attracting surface 760 and the support surface 702, which field attracts the powder particles towards the attracting surface 760. An air supply 785 injects air through an air outlet 786 to a point between the attracting surface 760 and the first side 703 which is upstream of the location of the end point 752 of the path. At an opposite side of the path, air outlet 784 which extends through housing wall 777 is connected to an air pump 783 for removing air from the housing. Thus the air pressure between inner side 763 of the attracting surface 760 and the first side 703 of the support surface 702, e.g. at point P1, is less than the air pressure between outer side 764 of the attracting surface 760 and the substantially air-tight housing 775,776,777, e.g. at point P2, such that the powder particles are urged from the inner side 763 of the attracting surface, through openings 761 in the attracting surface to the outer side 764 of the attracting surface 760 after which they can be filtered from the air in a manner similar as described for FIG. 1. The phrase "air-tight" herein does not necessarily mean completely air tight, but sufficiently air tight to substantially prevent air carrying powder particles from flowing through the walls 775,776,777 of the housing.

For keeping the carrier particles attracted to the first side 703 of the support surface 702, the apparatus 700 is provided with a plurality of magnets 753,754 arranged on a roll 757 which is rotatable relative to the support surface 702 and arranged on a second side 704 of the support surface which is opposite to said first side 703, i.e. arranged on the inner side of the support cylinder 702. The plurality of magnets 753,754 is partitioned into a number of parallel and distinct sections 756,757, with the magnets within each section 756,757 arranged with a same magnetic pole proximate to the first side 703 of the support cylinder 702. Neighboring sections 756,757 of magnets are spaced apart from each other and held in place by aluminum strips 755, though any kind of other substantially non-ferromagnetic material may be used for this purpose.

The first side 703 of the support cylinder 702 is provided with a spiral strip 780 which defines a spiraling path around said first side for carrier particles of the magnetic brush to follow. The spiral strip 780 comprises a first layer 781 comprising a ferromagnetic material, and a second layer 782 comprising an electrically insulating material, e.g. rubber tape, which is attached to the first layer using an adhesive and has a substantially greater height than the first layer. In the embodiment shown the metallic first layer has a height of between 0.2 and 0.6 mm, and the insulating second layer has a height of at least 4 mm.

The different sections 756,757 of magnets together exert a magnetic force on the carrier particles of the magnetic brush, over substantially the entire outer surface 703 of the cylindrical support 702 between at least between starting point 751 and end point 752 of the path defined by spiral 780. Thus when the carrier particles travel along the spiral 780 from the starting point 751 towards the end point 752, the magnets keep the carrier particles attracted to the first side 703. To ensure that there is sufficient magnetic force at the entire first side 703 of the cylindrical support 702, the different sections 756,757 are arranged radially around the longitudinal axis of the roll 757, with neighboring sections arranged close enough to each other for attracting carrier particles arranged on or between the neighboring sections to the first side 703.

The maximum height of the magnetic brush is substantially defined by the distance h5 of the supply outlet 222 of the mixture supply device 230 (see also FIG. 2A) to the first side 703 of the support cylinder 702. In the embodiment shown the height of the spiral strip 780 is greater than the maximum height of the magnetic brush, so that the carrier particles are prevented from traveling over and across the spiral 780 along the longitudinal direction of the support cylinder. As a result carrier particles which travel over the first side 703 from starting point 751 to end point 752 follow the entire spiral. Though not shown, the spiral strip 780 could also be arranged to contact both the attracting surface 760 and the first side 702 of the support surface 703.

In an alternative embodiment, not shown, the height of the spiral strip 780 may be substantially less than the maximum height of the magnetic brush of carrier particles to be supported by the first side 703 of the support cylinder 702. Because the height of the spiral strip 780 is substantially less than the maximum height of the magnetic brush, e.g. less than the distance h5, at least some of the carrier particles which travel across the first side of the support cylinder 702 from the staring point 751 towards the end point 752 may travel over and across the spiral strip 780 along the longitudinal direction of the cylinder L'. Thus in case a mass of carrier particles on the first side clogs a portion of the path defined by the spiral 780, carrier particles in the magnetic brush which are arranged at a greater distance from the first side 703 than the height of the spiral may still move along the first side when the magnet roll 757 is rotated relative to the stationary first side 703. In such a case the total length of the path traveled by the carrier particles remains substantially larger than the length of the cylinder 702 along its longitudinal axis L'.

FIG. 7B shows a cross-section along line VIIB-VIIB of FIG. 7A. When the roll 757 with the plurality of magnets 755,756 rotates in a first direction of rotation R1 relative to the first side 703 of the support cylinder 702, this causes carrier particles in the magnetic brush to travel along the spiral 780 along an opposite second direction of rotation R2. During rotation of the magnets the support surface 702 and the attracting surface 760 remain substantially stationary to the substantially air-tight housing 775,776. At the end point 752 of the path defined by the spiral 780 (see FIG. 7A) the support surface 703 transitions into a ramped surface, or thickened portion 795. When the carrier particles are near the end point of the path, they are driven onto this ramped surface, increasing the distance between the magnets and the carrier particles, until the magnetic force on the carrier particles is insufficient to attract them to the first side or ramped surface thereof, and the carrier particles fall into carrier particle container 790. To further facilitate movement of carrier particles away from the plurality of magnets and into the carrier particle container 790, a rotating brush 797 is provided, which rotates in a direction R3 counter to direction R2 in which the carrier particles move over the first side 703.

Figure 7C:
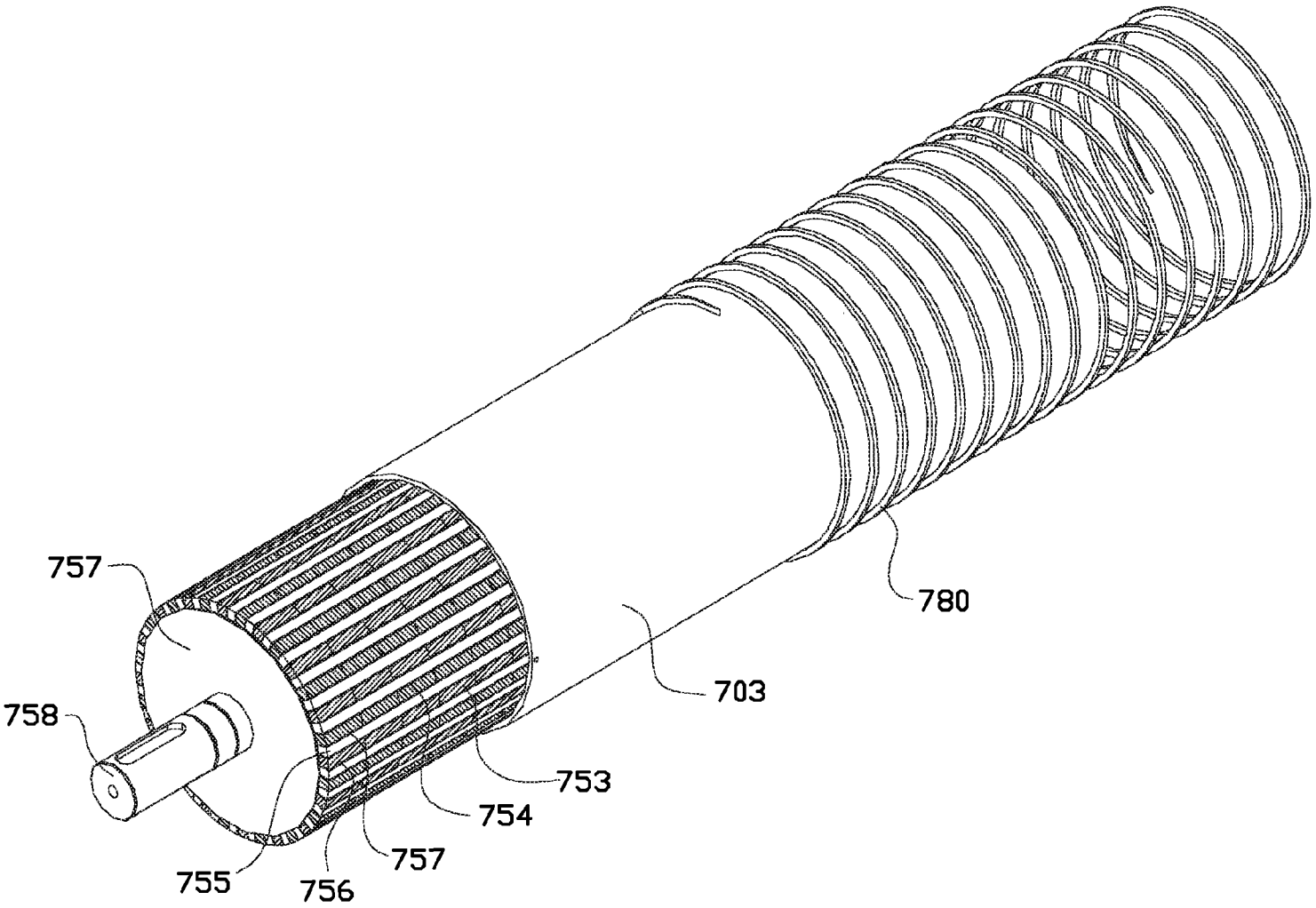

As mentioned before the air pressure P1 between the inner side 763 of the attracting surface 760 and the first side 703 is higher than the air pressure P2 between the outer side 764 of the attracting surface 760 and the cylindrical housing portion 775 to facilitate transportation of the powder particles away the attracting surface 760. In order to prevent powder particles from entering the particle container 790, the particle container is substantially air-tight except for at an inlet for receiving carrier particles. Thus at point P3 there is substantially no air flow for blowing carrier or powder particles into or out of the carrier particle container. The inlet is arranged an area close to the ramped portion 795 which is located substantially outside of the airstream generated by the air supply 785 and air manifold 783. FIG. 7C schematically shows an exploded view of a cylindrical support surface 703, magnet roll 757 and spiral 780 of FIGS. 7A and 7B. The cylindrical first side 703, or outer surface, of the support is provided with the spiral 780 which extends over substantially the same length as the sections 757,756 of magnets 753,754. Within each section the magnets are arranged with a same magnetic pole proximate to the first side 703. Magnets of neighboring sections are arranged with opposite poles proximate to the first side 703. The plurality of magnets in the distinct sections are held in place by means of the aluminum strips 755.

It is to be understood that the above description is included to illustrate the operation of the preferred embodiments and is not meant to limit the scope of the invention. From the above discussion, many variations will be apparent to one skilled in the art that would yet be encompassed by the spirit and scope of the present invention.

For example, although in the present exemplary embodiments the driving element is adapted for driving a mechanical movement of the support surface relative to said plurality of magnets, a person skilled in the art would understand that, in the case that the magnets are electromagnets, the driving element may be adapted for switching subsequent electromagnets for driving movement of the magnetic fields generated by the electromagnets relative to said support surface.

The invention claimed is:

1. The powder purging apparatus for purging charged powder particles from a mixture of ferromagnetic carrier particles and said powder particles, comprising:

a support surface comprising a first side for supporting said carrier particles;

a plurality of magnets, arranged on a second side of said support surface opposite from said first side, for generating magnetic fields at said first side to attract said carrier particles to said first side for forming a magnetic brush of said carrier particles, wherein said magnetic fields and said support surface are moveable relative to each other;

a driving element adapted for driving movement of said magnetic fields relative to said support surface;

an attracting surface facing said first side and spaced apart there from; and a field generator adapted for generating an electrical field between said attracting surface and said support surface for attracting said powder particles located at the magnetic brush away from the carrier particles and towards said attracting surface, wherein said magnetic brush of carrier particles is spaced apart from said attracting surface.

2. The powder purging apparatus according to claim 1, further comprising a mixture supply device for supplying said mixture to said first side.

3. The powder purging apparatus according to claim 2, wherein said mixture supply device comprises a supply outlet spaced apart from said first side by a distance substantially equal to a predetermined maximum height of said brush of carrier particles.

4. The powder purging apparatus according to claim 2, wherein said mixture supply device comprises fluidizing means for fluidizing said mixture.

5. The powder purging apparatus according to claim 1, wherein said plurality of magnets and said support surface are moveable relative to each other, and wherein the driving element is adapted for driving movement of said support surface relative to said plurality of magnets.

6. The powder purging apparatus according to claim 1, wherein said support surface comprises a sleeve having a longitudinal axis, wherein said first side is substantially cylindrical and arranged around said plurality of magnets and wherein said plurality of magnets extend radially from said longitudinal axis.

7. The powder purging apparatus according to claim 6, wherein said first side is provided with a spiral for guiding movement of the carrier particles along a path having a starting point and an end point, wherein said starting point and said end point are spaced apart along said longitudinal axis.

8. The powder purging apparatus according to claim 7, wherein said spiral is a spiral strip comprising a first layer comprising a ferro-magnetic material, and a second layer, preferably arranged on top of the first layer, comprising or made of a substantially electrically non-conductive material.

9. The powder purging apparatus according to claim 7, further comprising a carrier particle container arranged at or downstream of said end point of said path.

10. The powder purging apparatus according to claim 9, further comprising a rotating brush close to the end point and the carrier container, for brushing carrier particles away from the end point and into the carrier particle container or an inlet thereof.

11. The powder purging apparatus according to claim 1, wherein, at least during use, said attracting surface is substantially rotationally fixed relative to said support surface, or wherein, at least during use, said attracting surface is substantially rotationally fixed relative to said plurality of magnets.

12. The powder purging apparatus according to claim 1, wherein said attracting surface comprises a plurality of openings for letting through powder particles from a first side of said attracting surface facing said support surface to a second side of said attracting surface facing away from said support surface.

13. The powder purging apparatus according to claim 12, further comprising an air manifold connected to a vacuum source, wherein said air manifold is arranged adjacent to said attracting surface for removing powder particles from said first side of the attracting surface.

14. The powder purging apparatus according to claim 1, wherein said attracting surface substantially envelops said first side of the support surface.

15. The powder purging apparatus according to claim 1, wherein the support surface is moveable from a first position in which said plurality of magnets is arranged for generating said magnetic field at said first side for attracting said carrier particles to said first side, to a second position in which said first side is substantially outside the magnetic field generated by said plurality of magnets, and wherein the support surface is moveable from the second position to the first position.

16. A method of purging charged powder particles from a mixture of ferromagnetic carrier particles and said powder particles, comprising:

supplying said mixture to a first side of a support surface;

attracting said carrier particles of said mixture to said first side using a plurality of magnets arranged on a second side of said support surface opposite to said first side to generate magnetic fields to form a magnetic brush of said carrier particles on said first side;

moving said magnetic fields relative to said support surface;

generating an electrical field between said support surface and an attracting surface for attracting said charged powder particles located at the magnetic brush away from the carrier particles and spaced apart from and facing said first side, wherein said magnetic brush of carrier particles is spaced apart from said attracting surface.

17. The method according to claim 16, wherein said attracting surface is substantially rotationally fixed relative to said support surface while movement of said plurality of magnets is driven relative to the support surface.

18. The method according to claim 16, further comprising a step of fluidizing said mixture prior to supplying said mixture to said first side of the support surface.

19. The method according to claim 16, wherein said first side has a cylindrical shape and wherein said carrier particles are moved relative to said first side by rotating first side relative to said plurality of magnets, wherein said magnets of said plurality of magnets are arranged substantially along a spiraling path having a starting point and an end point, wherein the starting point and the end point are spaced apart along a longitudinal axis of said cylindrical shape, wherein said mixture is substantially continuously supplied to said first side at said starting point, and wherein carrier particles on said first side are substantially continuously moved over said first side along said spiraling path towards said end point.

20. The method according to claim 16, further comprising a step of placing a substrate to be provided with said powder particles between the attracting surface and the first side, spaced apart from said first side.

21. The method according to claim 16, wherein substantially all of said mixture is supplied to said first side, and wherein said mixture comprises a substantially predetermined amount of powder particles.

22. The powder purging apparatus according to claim 1, wherein the magnets face the first side of the support surface with alternating north-south polarities.

23. The powder purging apparatus according to claim 1, wherein the attracting surface extends along a portion the first side of the support surface.

24. The powder purging apparatus according to claim 23, wherein the attracting surface extends along the entire first side of the support surface.

25. The powder purging apparatus according to claim 7, wherein the strength of the magnets of the plurality of magnets decreases towards the end point of the spiral path.

26. The powder purging apparatus according to claim 1, wherein the plurality of magnets is placed, such that the magnets are arranged to form the magnetic brush at a portion of the first side to which the attracting surface is facing.

27. The powder purging apparatus according to claim 26, wherein the plurality of magnets is placed, such that the magnets are arranged to form the magnetic brush at substantially the entire circumference of the first side.

28. The powder purging apparatus according to claim 26, wherein a plurality of magnets is arranged in a spiraling path around the longitudinal axis of the sleeve.

29. The powder purging apparatus according to claim 27, wherein a plurality of magnets is arranged in a spiraling path around the longitudinal axis of the sleeve.

30. The powder purging apparatus according to claim 6, wherein the attracting surface and the support surface are concentric.

* * * * *